US006210194B1

(12) United States Patent
Choy

(10) Patent No.: US 6,210,194 B1
(45) Date of Patent: Apr. 3, 2001

(54) DUPLEX PROFILE CONNECTOR ASSEMBLY

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/498,828

(22) Filed: Feb. 4, 2000

Related U.S. Application Data

(63) Continuation-in-part of application No. 09/084,809, filed on May 26, 1998, now Pat. No. 6,126,472, which is a continuation of application No. 08/692,823, filed on Jul. 29, 1996, now Pat. No. 5,755,585, which is a continuation-in-part of application No. 08/393,704, filed on Feb. 24, 1995, now Pat. No. 5,833,478.

(51) Int. Cl.[7] ..... H01R 13/62
(52) U.S. Cl. ..... 439/326
(58) Field of Search ..... 439/328, 326, 439/327, 541.5, 64, 630, 636, 637

(56) References Cited

U.S. PATENT DOCUMENTS 4,747,790 * 5/1988 Masuda et al. ..... 439/326
4,756,694 * 7/1988 Billman et al. ..... 439/61
5,030,115 * 7/1991 Regnier et al. ..... 439/541.5
5,176,523 * 1/1993 Lai ..... 439/541.5
5,415,573 * 5/1995 Chen et al. ..... 439/326
5,641,295 * 6/1997 Koyama ..... 439/326
5,697,802 * 12/1997 Kawabe ..... 439/326
5,839,913 * 11/1998 Fumikura ..... 439/326
5,915,979 * 6/1999 Schell et al. ..... 439/83
5,993,234 * 11/1999 Yodogawa ..... 439/326
6,077,098 * 6/2000 Yu et al. ..... 439/326

* cited by examiner

*Primary Examiner*—Gary F. Paumen
(74) *Attorney, Agent, or Firm*—Wei Te Chung

(57) ABSTRACT

A duplex profile connector assembly (1) including an insulative housing (10) defining an upper section (12) and a lower section (14). The upper section (12) defines an upper central slot (16) and the lower section (14) defines a lower central slot (18). A row of first passageways (22) are formed in a front half portion (24) of the housing (10), and a row of second passageways (26) are formed in a rear half portion (28) of the housing (10). The first passageways (22) and the second passageways (26) are alternately arranged in a staggered manner along a lengthwise direction of the housing (10). A plurality of first type contacts (30) are respectively received within the corresponding first passageways (22) and each first type contact (30) includes upper and lower spring arms (34, 36) respectively extending into the upper central slot (16) and the lower central slot (18) for engagement with the corresponding modules. Similarly, a plurality of second type contacts (40) are respectively received within the corresponding second passageway (26) and each second type contact (40) includes upper and lower spring arms (44, 46) respectively extending into the upper central slot (16) and the lower central slot (18) for engagement with the corresponding modules.

1 Claim, 5 Drawing Sheets

DUPLEX PROFILE CONNECTOR ASSEMBLY (This is a continuation-in-part of the application Ser. No. 09/084,809 filed May 26, 1998, now U.S. Pat. No. 6,126,472 which is a continuation of application Ser. No. 08/692,823 filed Jul. 29, 1996, now U.S. Pat. No. 5,755,585, which is a continuation-in-part of application Ser. No. 08/393,704 filed Feb. 24, 1995, now U.S. Pat. No. 5,833,478.)

BACKGROUND OF THE INVENTION

1. Field of the Invention

The invention relates to double deck connector assemblies, and particularly to the connector including the unitary housing with at least two different type contacts respectively and alternately insertably received within the corresponding passageways from opposite sides of the housing.

2. The Related Art

The copending parent application Ser. No. 09/084,809 filed May 26, 1998, discloses a duplex profile connector assembly including stacked upper and lower housings. Each housing defines two rows of passageways by two sides of the central slot, and two rows of contacts are respectively inserted into the corresponding passageways from two sides of the housing. Each housing is adapted to receive therein a module wherein the module defines conductive pads on two opposite surfaces respectively mechanically nd electrically connected to the corresponding contacts by two sides of the central slot. Understandably, based on this design, four-line solder tails, of which two lines are of the upper housing and the other two lines of for the lower housing, can be applied to the mother board on which the connector assembly is seated, thus achieving an incredibly high density arrangement of the contacts/conductors with a relatively compact connector assembly.

Even though the parent application discloses the arrangement which may satisfy the high density or complicate/delicate requirements, some simplified, economic type arrangements are also desired for some mother board design manufacturers. For example, U.S. Pat. No. 5,697,802 discloses another type double deck connector assembly including a unitary housing with two types contacts alternately inserted into the housing from the back wherein each contact extends into both the upper housing and the lower housing for simultaneous engagement with both the upper and lower modules in respective housings. It can be understood that under this application, only one solder tail of each such contact is soldered to the mother board on which the connector assembly is seated, and such solder tail is the sole means for each contact to transmit signals between the mother board and both two modules. In other words, the upper module and the lower module share the same transmission path (i.e., the contact) with each other for communication with the mother board.

The design used in U.S. Pat. No. 5,697,802 is too simply to be practical because all of the contacts are inserted into the unitary housing from the back. Installation of the contacts from only one side inevitably results in a low density arrangement of the contacts which may not quite satisfactorily meet the modern system specification defined by the computer manufacturer.

Therefore, it is desired to have a medium design essentially characterized between the parent application with a relatively complicate arrangement and U.S. Pat. No. 5,697,802 with a relatively simple arrangement, wherein such a medium design may own the medium density contact arrangement with regard to the housing while keeping simplified structures of each contact for engagement with both the two modules respectively in the upper and lower housings.

SUMMARY OF THE INVENTION

According to an aspect of the invention, a double-deck connector assembly includes a unitary housing defining upper and lower sections with upper and lower central slots for respectively receiving the corresponding modules therein. A pair of latching arms extend from two opposite ends of each section for retaining the corresponding module in position. A row of first passageways are formed in the front half portion of the housing wherein each of the first passageways extends into both the upper section and the lower section and simultaneously communicates with both the upper and the lower central slots. A row of second passageways are formed in the rear half portion wherein each of the second passageways extends into both the upper section and lower section and simultaneously communicates with both the upper and the lower central slots. The first passageways and the second passageways are arranged in a staggered manner with one another along the lengthwise direction of the housing. A plurality of first type contacts are respectively inserted into said first passageways from a front-to-back direction wherein each first type contact includes a first main body, upper and lower first spring arms respectively extending forwardly therefrom and into the upper and the lower central slots, and an SMT type first solder tail forwardly extending therefrom. A plurality of second type contacts are respectively inserted into one of said second passageways from a back-to-front direction wherein each second type contact includes a second main body, upper and lower second spring arms respectively extending forwardly therefrom and into the upper and the lower central slots, and an SMT type second solder tail rearwardly extending therefrom.

In each of some predetermined first passageways, the first type contact is replaced by a pair of third and fourth type contacts, of which both are inserted into the same corresponding first passageway from a front-to-back direction, wherein the third type contact is positioned in the lower section with a third spring arm extending into the lower central slot, and an SMT type forwardly extending third solder tail, while the fourth type contact is positioned in both the upper and the lower sections with a fourth spring arm extending into the upper central slot, and a through hole type vertically extending fourth solder tail. Similarly, in each of some predetermined second passageways, the second type contact is replaced by a pair of fifth and sixth type contacts, of which both are inserted into the same corresponding second passageway from the back-to-front direction, wherein the fifth type contact is positioned in the lower section with a fifth spring arm extending into the lower central slot, and a through hole type vertically extending fifth solder tail, while the sixth type contact is positioned in both the upper and the lower sections with a sixth spring arm extending into the upper central slot, and an SMT type rearwardly extending sixth solder tail.

DETAILED DESCRIPTION OF THE PREFERRED EMBODIMENTS

Figure 1:
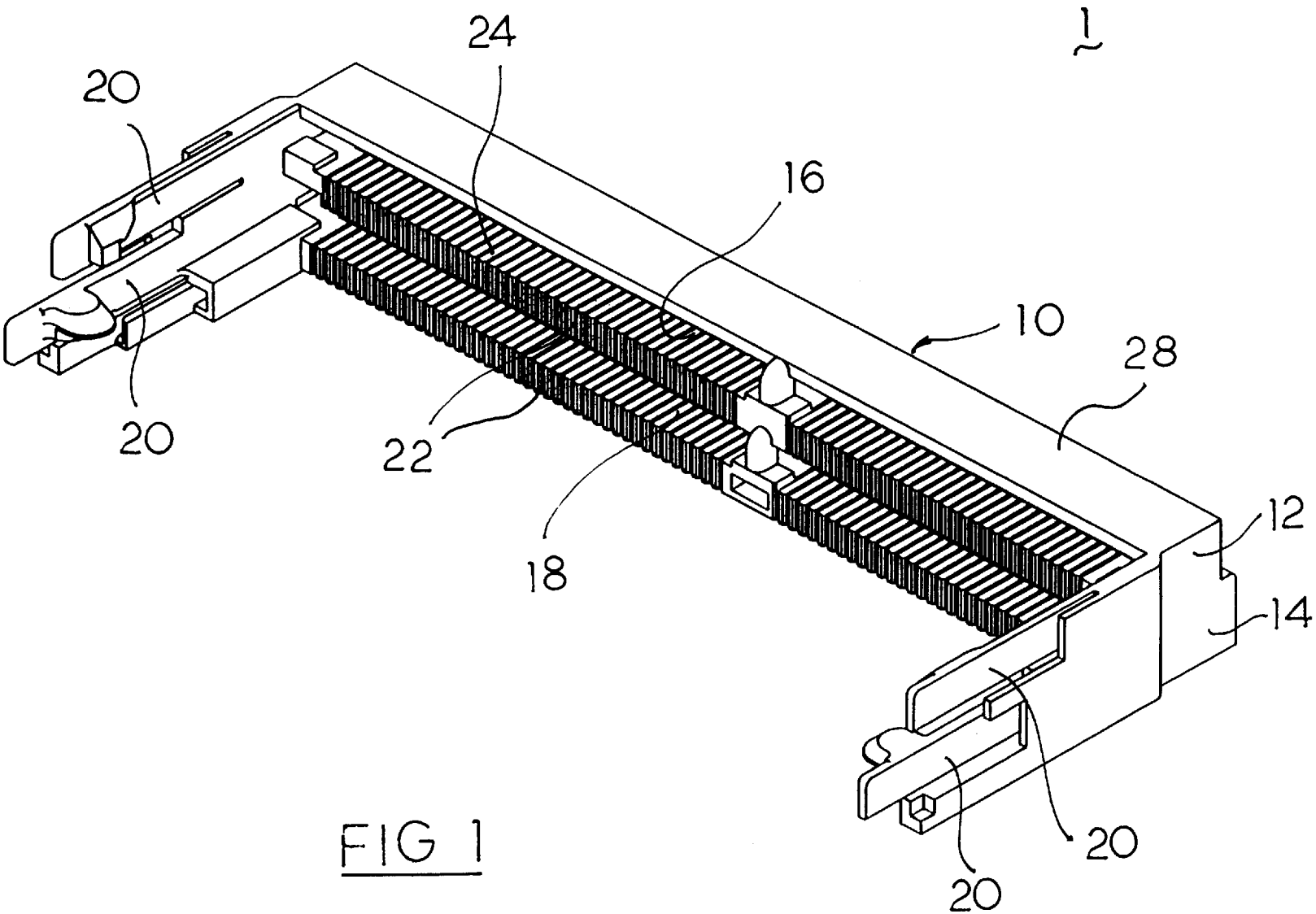
FIG. 1 is a front perspective view of the preferred embodiment of the duplex profile connector assembly, according to the invention, without contacts therein.
Figure 2:
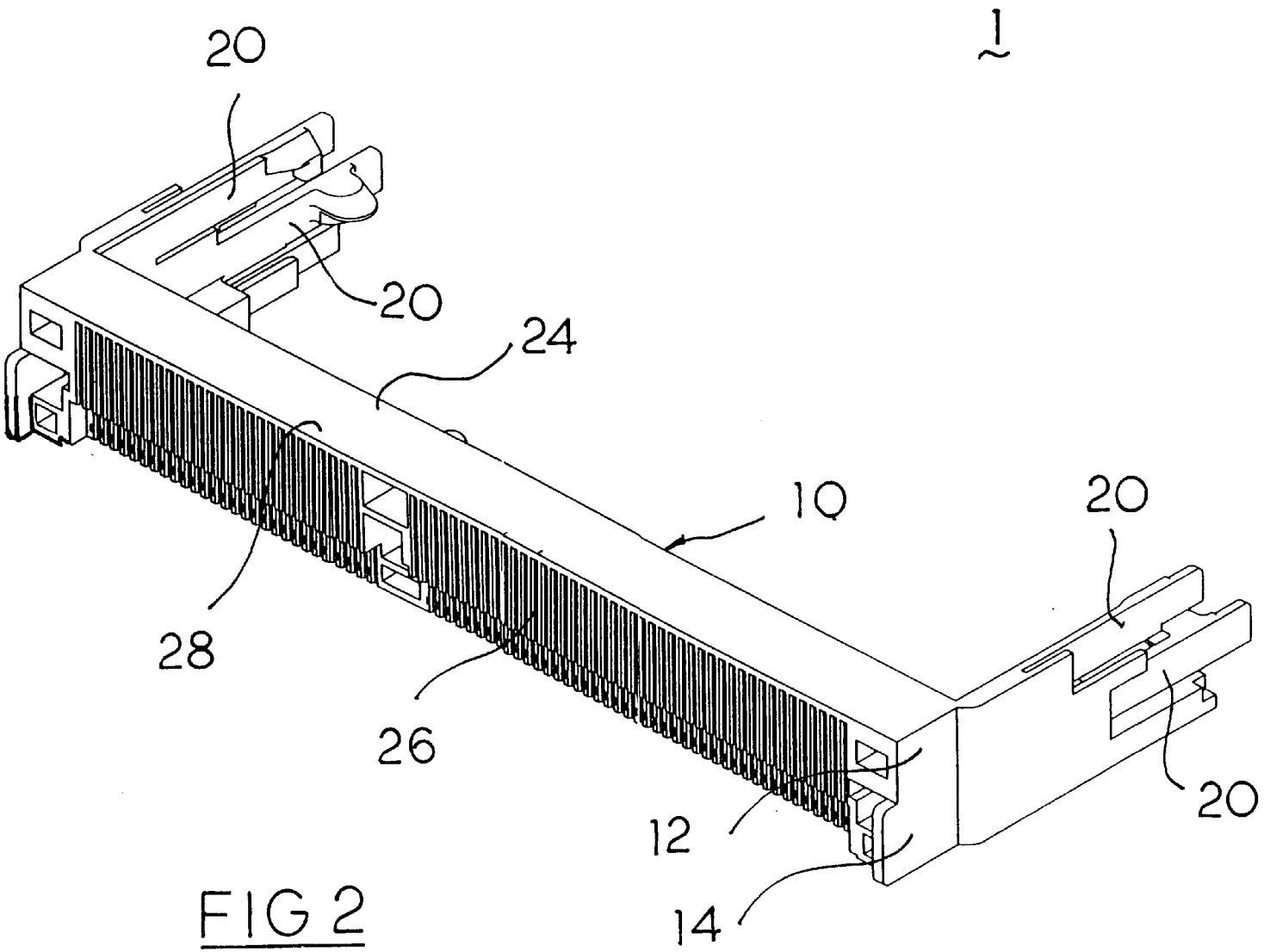
FIG. 2 is a rear perspective view of the connector assembly of FIG. 1 without contacts therein.
Figure 3B:
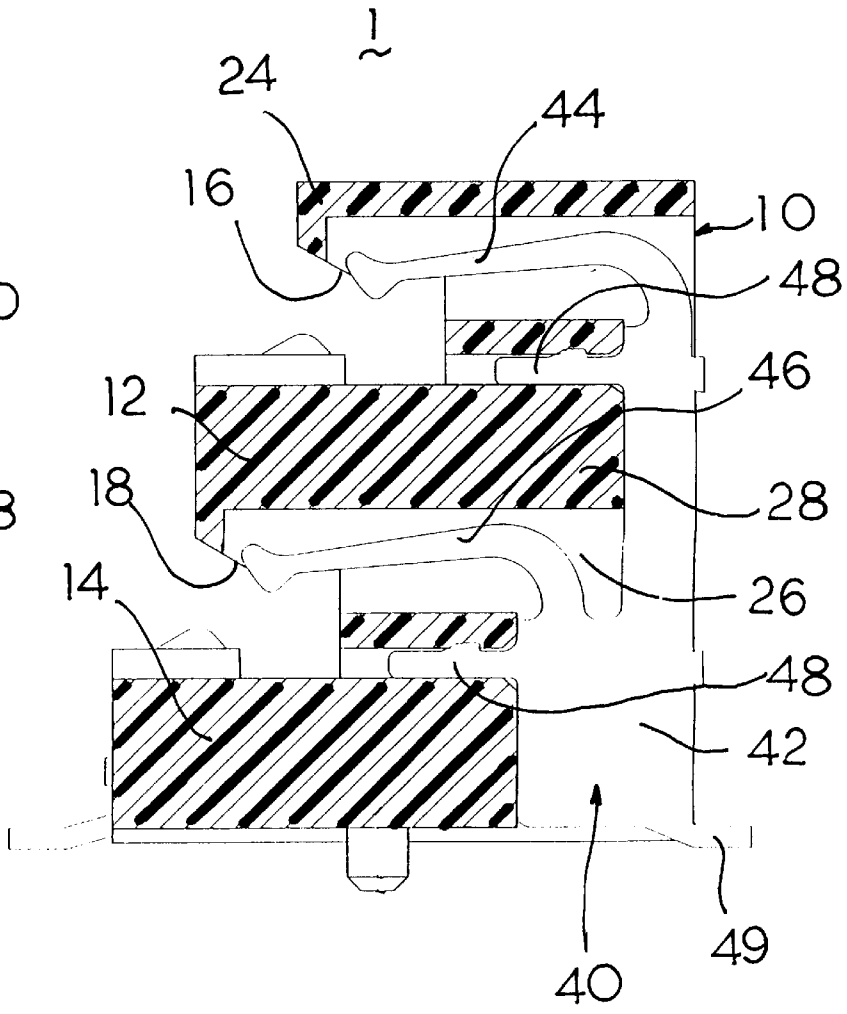
FIG. 3(B) is a cross-sectional view of the connector assembly of FIG. 1 with contacts therein to show the second type contacts are insertably, from a back-to-front direction, received within the corresponding second passageway.
Figure 3A:
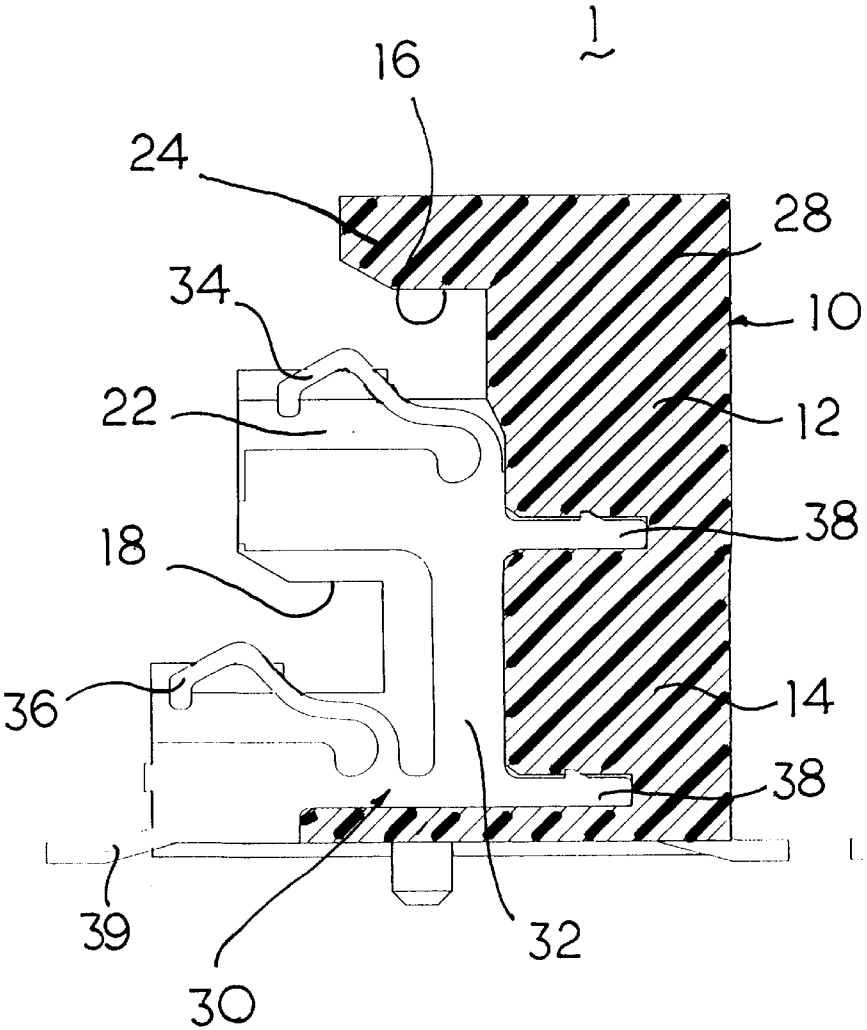
FIG. 3(A) is a cross-sectional view of the connector assembly of FIG. 1 with contacts therein to show the first type contacts are insertably, from a front-to-back direction, received within the corresponding first passageway.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1 to 3(B) wherein a duplex profile connector assembly 1 includes an unitary housing 10 defining an upper section 12 and a lower section 14. The upper and lower sections 12, 14 respectively define upper and a lower central slots 16, 18 for respectively receiving upper and lower modules (not shown) therein. A pair of latching arms 20 respectively extend forward from two opposite ends of each of the upper and lower sections 12, 14 for respectively retaining the corresponding modules (not shown) in position with regard to the housing.

A row of first passageways 22 are formed in the front half portion 24 of the housing 10 wherein each first passageway 22 extends into both the upper section 12 and the lower section 14, and simultaneously communicates with both the upper central slot 16 and the lower central slot 18. A row of second passageway 26 are formed in the rear half portion 28 of the housing 10 wherein each second passageway 26 extends into both the upper section 12 and the lower section 14, and simultaneously communicates with both the upper central slot 16 and the lower central slot 18. The first passageways and the second passageways are arranged in a staggered manner with one another along the lengthwise direction of the housing 10.

A plurality of first type contacts 30 are respectively inserted into the corresponding first passageways 22 in a front-to-back direction. Each first type contact 30 includes a first main body 32, an upper first spring arm 34 and a lower first spring arm 36 respectively extending forward therefrom and into the upper central slot 16 and the lower central slot 18 for respective engagement with the upper and lower modules (not shown). It can be seen that both the upper first spring arm 34 and the lower first spring arm 36 project around the lower portions of the corresponding upper central slot 16 and the lower central slot 18, and thus are ready to be respectively engaged with the bottom surfaces of the upper and lower modules (not shown). A pair of first retention sections 38 extend from the first main body 32 and interfere with the housing 10. An SMT type first solder tail 39 forwardly extends from the first main body 32.

Similarly, a plurality of second type contacts 40 are inserted into the corresponding second passageways 26 in a back-to-front direction, respectively. Each second type contact 40 includes a second main body 42, an upper second spring arm 44 and a lower second spring arm 46 respectively extend from the second main body 42 and into the corresponding upper central slot 16 and the lower central slot 18 for respective engagement with the corresponding upper and lower modules (not shown). It can been seen that the upper second spring arm 44 and the lower second spring arm 46 project around the upper portions of the upper central slot 16 and the lower central slot 18, and thus are ready to be respectively engaged with the upper surfaces of the modules (not shown). A pair of second retention sections 48 extend from the second main body 42 and interfere with the housing 10. An SMT type second solder tail 49 extends rearwardly from the second main body 42.

Figure 4B:
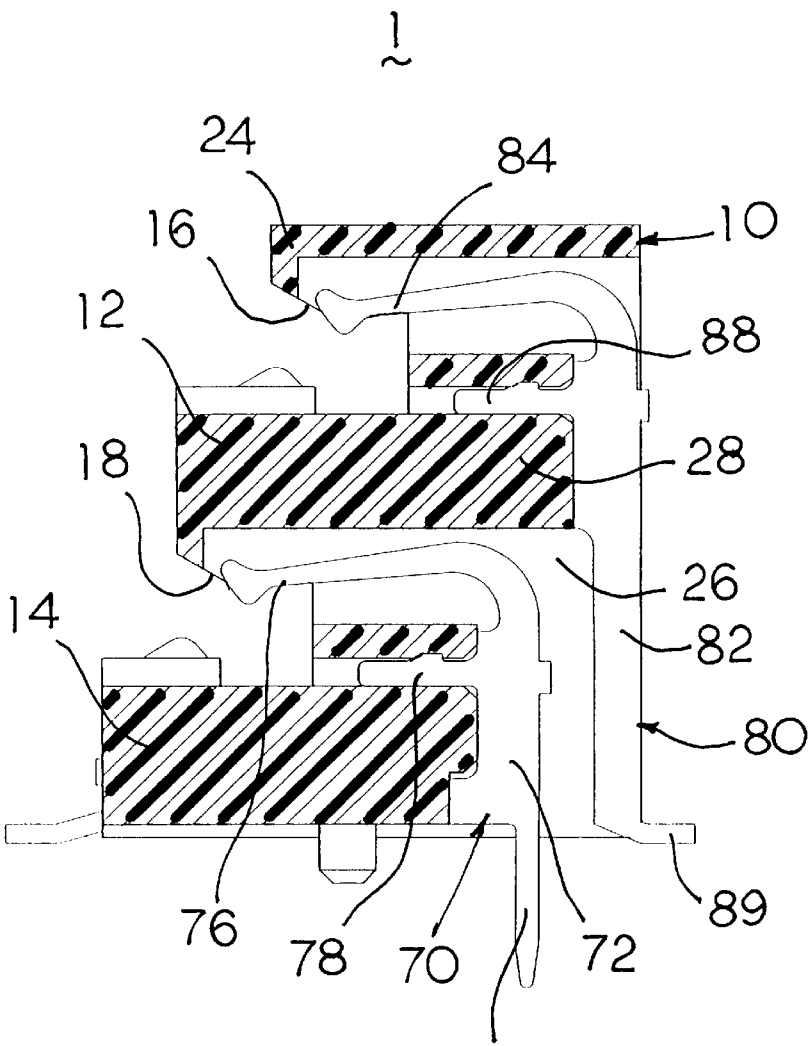
FIG. 4(B) is a cross-sectional view of the connector assembly of FIG. with contacts therein to show the fifth and the sixth type contacts are insertably, from a back-to-front direction, received within the same corresponding second passageway.
Figure 4A:
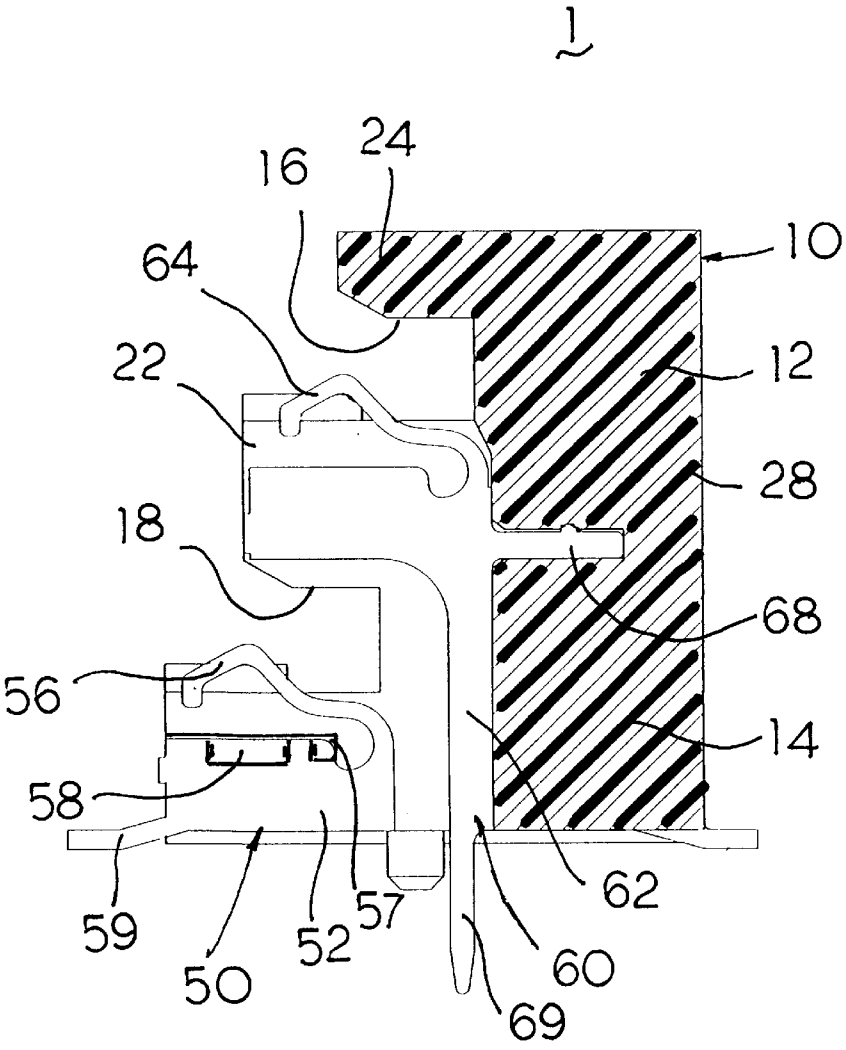
FIG. 4(A) is a cross-sectional view of the connector assembly of FIG. 1 with contacts therein to show the third and the fourth type contacts are insertably, from a front-to-back direction, received within the same corresponding first passageway.

Referring to FIGS. 4(A) and 4(B), in some specific predetermined first passageway 22, the first type contact 30 in each first passageway 22 is replaced by a relatively shorter third contact 50 and a relatively taller fourth contact 60, of which both are inserted into the same first passageway 22 in a front-to-back direction, wherein the third contact 50 includes a third main body 52 positioned in the lower section 14 with a third spring arm 56 extending therefrom into the lower central slot 18 for engagement with the corresponding lower module (not shown), a retention embossment 58 formed thereon for being retainably interferentially engaged within the recess 57, beside the corresponding first passageway 22, in the lower section 14 of the housing 10, and an SMT type third solder tail 59 forwardly extending therefrom. Similarly, the fourth type contact 60 includes a fourth main body 62 generally positioned within both the upper section 12 and the lower section 14 with a fourth spring arm 64 extending therefrom into the upper central slot 16 for engagement with the corresponding upper module (not shown), a retention section 68 extending therefrom and interfering with the upper section 12 of the housing 10, and a through hole type fourth solder tail 69 vertically extending therefrom.

Similarly, in some specific predetermined second passageways 26, the second type contact 40 in each second passageway 26, is replaced by a relatively shorter fifth type contact 70 and a relatively taller sixth type contact 80, of which both are inserted into the same second passageway 26 in a back-to-front direction, wherein the fifth type contact 70 includes a fifth main body 72 positioned in the lower section 14 with a fifth spring arm 76 extending into the lower central slot 18, a fifth retention section 78 extending therefrom and interfering with the lower section 14, and a through hole type fifth solder tail 79 extending vertically therefrom. Similarly, the sixth type contact 80 includes a sixth main body 82 positioned in both the upper section 12 and the lower section 14 with a sixth spring arm 84 extending into the upper central slot 16, a sixth retention section 88 extending therefrom and interfering with the upper section 12, and an SMT type sixth solder tail extending rearwardly therefrom.

Figure 5:
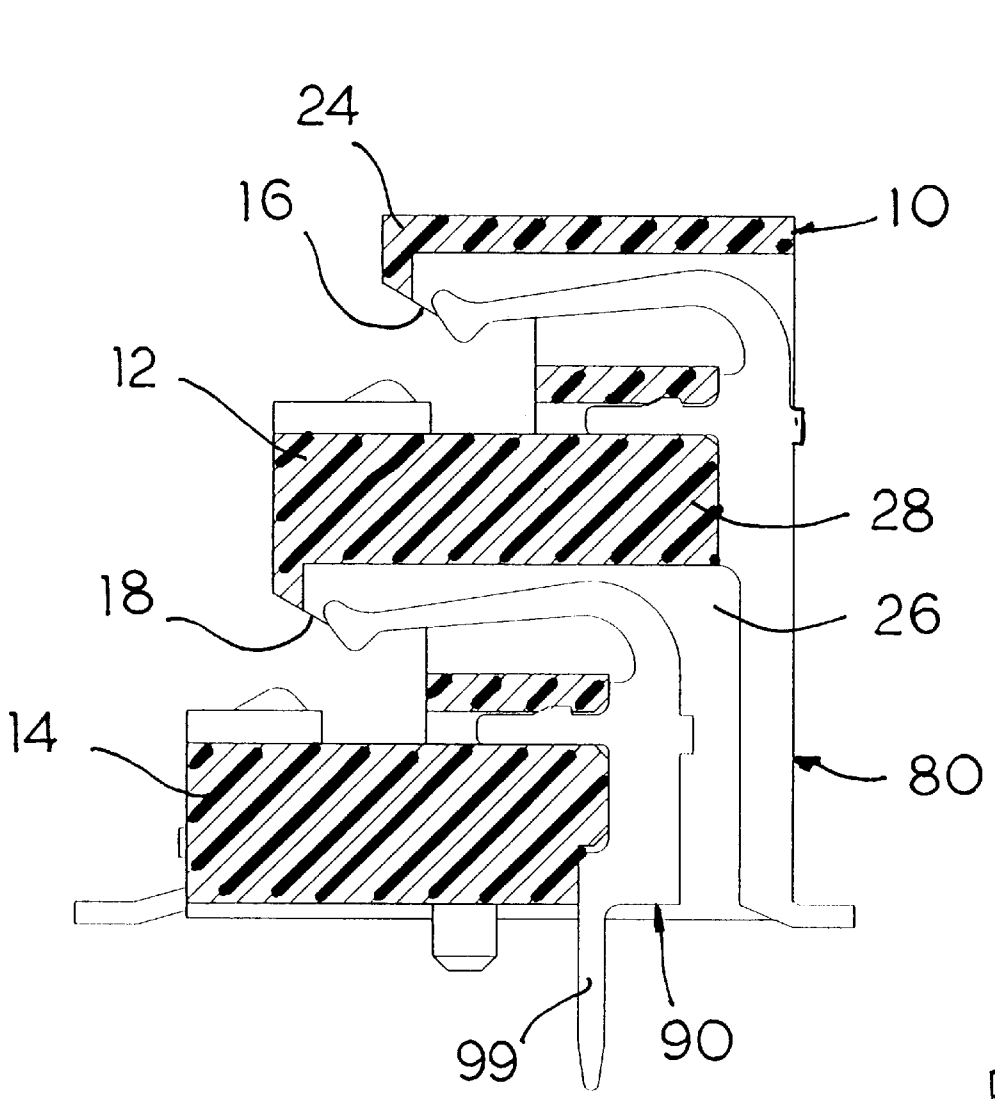
FIG. 5 is a cross-sectional view of the connector assembly of FIG. 1 with contacts therein to show the seventh and the sixth type contacts are insertably, from a back-to-front direction, received within the same corresponding second passageway.

Referring to FIG. 5, in some specific predetermined second passageways 26, the firth type contact 70 is replaced by the seventh type contact 90 wherein the difference between the fifth type contact 70 and the seventh type contact 90 is that the through hole type seventh solder tail 99 is offset from the through hole type fifth solder tail 79 in a back-to-front direction. This alternation is to forgive the space limitations of the two adjacent retention holes in the mother board (not shown) on which the connector assembly 1 is seated whereby the offset through hole type solder tail may allow two offset adjacent corresponding retention holes to be formed in the mother board (not shown), thus avoiding inoperativeness of two laterally aligned retention holes in the mother board (not shown).

It is appreciated that as shown in FIG. 4(A), in some first passageways 22, the third type contacts 50 and the fourth type contacts 60 replace the original first type 30, thus diversifying the circuit design for implementing variant signal/power transmission of the whole connector assembly. Understandably, as shown in FIG. 4(B), the fifth type contact 70 and the sixth type contact 80 own the similar characteristics as the third type contact 50 and the fourth type contact 60.

It can be contemplated that the invention provides a medium design characterized between the relatively too simplified design of the aforementioned U.S. Pat. No. 5,697,802 and the relatively somewhat complicated design of the copending parent application, which essentially meets the current industry electrical requirements. The planewise type contacts including the integral type contacts 30, 40, and the separate type contacts 50, 60, 70, 80 and 90, are easy to be made, and cooperate with the offset arranged upper and lower central slots 16, 18, thus resulting in easy and reliably assembling to the housing 10.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim.

Therefore, person of ordinary skill in this field are to understand that all such equivalent structures are to be included within the scope of the following claims.

I claim:

1. A connector assembly comprising:

an insulative housing including an upper section and a lower section respectively defining an upper central slot and a lower central slot for respectively receiving upper and lower modules therein;

a row of first passageways formed in a front half portion of the housing and extending into both the upper section and the lower section in communication with both the upper central slot and the lower central slot, respectively;

a row of second passageways formed in a rear half portion of the housing and extending into both the upper section and the lower section in communication with both the upper central slot and the lower central slot, respectively;

said first passageways and said second passageways being arranged in a staggered manner along a lengthwise direction of the housing;

a plurality of first type contacts respectively retainably received within the corresponding first passageways, each of said first type contacts including a main body with an upper first spring arm and a lower first spring arm respectively extending into the corresponding upper central slot and lower central slot; and a plurality of second type contacts respectively retainably received within the corresponding second passageways, each of said second type contacts including a main body with an upper second spring arm and a lower second spring arm respectively extending into the corresponding upper central slot and lower central slot;

wherein said first type contacts are respectively inserted into the corresponding first passageways from a front-to-back direction;

wherein said second type contacts are respectively inserted into the corresponding second passageways from a back-to-front direction;

wherein plural pairs of third and fourth type contacts are respectively retainably received within the corresponding first passageways, and in each pair of third type contact and fourth type contact disposed in the same first passageway, the third type contact is positioned in the lower section with a third spring arm extending into the lower central slot while the fourth type contact is positioned in both the upper and lower sections with a fourth spring arm extending into the upper central slot;

wherein said third type contacts are positioned in front of the corresponding fourth type contact, and the fourth type contact is first inserted into the corresponding first passageway and then the third type contact is successively inserted into the same corresponding first passageway;

wherein said third type contact includes an SMT-type third solder tail extending forwardly therefrom while the fourth type contact includes a through-hole type fourth solder tail extending downwardly therefrom;

wherein plural pairs of fifth and sixth type contacts are respectively retainably received within the corresponding second passageways, and in each pair of fifth and sixth type contacts disposed in the same corresponding second passageways, the fifth type contact is positioned in the lower section with a fifth spring arm extending into the lower central slot while the sixth type contact is positioned in both the upper and lower sections with a sixth spring arms extending into the upper central slot;

wherein said fifth type contacts are positioned in front of the corresponding sixth type contacts, and the fifth type contact is first inserted into the corresponding second passageway and then the sixth type contact is successively inserted into the same corresponding second passageway;

wherein said fifth type contact includes a through hole type fifth solder tail extending downwardly therefrom while the sixth type contact includes an SMT-type sixth solder tail extending rearwardly therefrom;

wherein a seventh type contact is positioned adjacent to the fifth type contact with a through hole type seventh solder tail offset from the through hole type fifth solder tail of the adjacent fifth type contact.

* * * * *